US008671625B2

(12) United States Patent
Imaoka et al.

(10) Patent No.: US 8,671,625 B2
(45) Date of Patent: Mar. 18, 2014

(54) MODULE STRUCTURE AND PLANT CONSTRUCTION METHOD

(75) Inventors: Shizuo Imaoka, Tokyo (JP); Shinichi Ebata, Tokyo (JP); Masaomi Wada, Tokyo (JP); Shigeru Fukushima, Tokyo (JP); Masatoshi Yoshizaki, Tokyo (JP); Nobuharu Satou, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 12/788,483

(22) Filed: May 27, 2010

(65) Prior Publication Data

US 2010/0300013 A1 Dec. 2, 2010

(30) Foreign Application Priority Data

May 29, 2009 (JP) ..... 2009-129918

(51) Int. Cl.

| | |
|---|---|
| ***E04H 1/00*** | (2006.01) |
| ***E04H 3/00*** | (2006.01) |
| ***E04H 5/00*** | (2006.01) |
| ***E04H 6/00*** | (2006.01) |
| ***E04H 9/00*** | (2006.01) |
| ***E04H 14/00*** | (2006.01) |

(52) U.S. Cl.
USPC ..... 52/79.12; 52/79.11; 52/79.14; 248/235

(58) Field of Classification Search
USPC ..... 52/79.5, 79.11, 79.12, 79.14, 79.1; 248/519, 235
See application file for complete search history.

(56) References Cited

U.S. PATENT DOCUMENTS

| | | | | |
|---|---|---|---|---|
| 3,103,709 | A * | 9/1963 | Bolt | 52/69 |
| 3,792,558 | A * | 2/1974 | Berce et al. | 52/79.7 |
| RE30,280 | E * | 5/1980 | Berman et al. | 290/1 R |
| 5,076,310 | A * | 12/1991 | Barenburg | 137/15.08 |
| 5,100,086 | A * | 3/1992 | Rinderer | 248/49 |
| 5,724,773 | A * | 3/1998 | Hall | 52/34 |
| 7,219,931 | B2 * | 5/2007 | Kato | 285/61 |
| 7,551,971 | B2 * | 6/2009 | Hillis | 700/90 |
| 7,607,274 | B1 * | 10/2009 | Gillen | 52/745.02 |
| 2005/0095082 | A1 * | 5/2005 | Maruyama | 411/429 |

FOREIGN PATENT DOCUMENTS

| | | |
|---|---|---|
| JP | 62-228975 | 10/1987 |
| JP | 2000-072379 | 3/2000 |
| JP | 2000-345621 | 12/2000 |
| JP | 2003-171989 | 6/2003 |

OTHER PUBLICATIONS

Office Action issued in Japanese Patent Application No. 2009-129918 on Feb. 27, 2013.

* cited by examiner

*Primary Examiner* — Brian Glessner
*Assistant Examiner* — Brian D Mattei
(74) *Attorney, Agent, or Firm* — Antonelli, Terry, Stout & Kraus, LLP.

(57) ABSTRACT

The present invention provides a module structure and a plant construction method capable of easily attaching a facility device of a plant and shortening a plant construction period. The module structure of the present invention includes a support member which temporarily supports a facility device component to be arranged in a cell constituting a plant at a designed position and which constitutes scaffolding for attaching the facility device component and forming the cell, a box-shaped frame which is possible to be carried into inner space of the cell while fixing the support member, and joint means which is detachably attachable and which temporarily assembles the support member and the frame.

9 Claims, 20 Drawing Sheets

MODULE STRUCTURE AND PLANT CONSTRUCTION METHOD

BACKGROUND (a) Field of the Invention

The present invention relates to a module structure and a plant construction method, and in particular, relates to a module structure and a plant construction method suitable for plant construction of nuclear power generation and the like.

(b) Description of the Related Art

A plant such as a nuclear power generation plant is a building of reinforced concrete structure and is divided into a plurality of cells for each facility device and the like. A plant construction method in the related art is roughly classified into a process to form a plurality of cells prepared by arbitrarily dividing a plant building for each attaching and the like of the facility device and a process to attach pipes and facility devices to be attached in each formed cell.

FIGS. 10A and 10B are explanatory views of a plant construction method in the related art. As illustrated in FIG. 10A, in a cell 1 which is prepared by dividing a plant building, operational scaffolding 5 for forming a wall face 3 is assembled after forming a concreted floor face 2 is completed. Then, after forming the concreted wall face 3 is completed, attaching operation of facility devices in the cell 1 is performed. Carrying-in of components constituting pipes and facility devices (hereinafter, called facility device components) 4 to be attached into the cell 1 is preformed from a ceiling face with a large crane. After completing the attaching of the facility devices in the cell 1, the ceiling face of the cell 1 is formed by pouring concrete into a formwork.

In such a construction method in the related art, there have been following problems.

(1) Since the operational scaffolding 5 for concrete wall casting for constructing a wall face 3 of the cell 1 remains therein, opening space of the ceiling face becomes small. Accordingly, the operational scaffolding 5 for concrete wall casting and facility device component 4 hung by the large crane are mutually interfered and the amount to be carried into the cell 1 is restricted. Further, since the amount of carrying-in for one time is restricted, there may be a case that carrying-in operation with the large crane has to be performed plural times.

(2) As illustrated in FIG. 10B, in the case that the facility device component 4 is attached to a vicinity of the wall face 3, the attaching operation has to be performed after moving the previously arranged operational scaffolding 5 for concrete wall casting. Accordingly, moving operation of the operational scaffolding is often required. There may be a case that moving operation of such scaffolding accompanies disassembling and assembling. In this case, the construction process is interrupted.

(3) When carrying-in is performed with a large crane, the facility device component 4 is temporarily placed on a floor face. Accordingly, as the construction of the facility devices proceeds, space for temporal placing becomes impossible to be ensured and the construction process is interrupted as similar to the above.

As described above, with the construction method in the related art, the concrete casting period and the carrying-in period of the facility devices overlap, so that the construction processes are significantly affected.

Meanwhile, there is a construction method which adopts a module structure to which the facility device components 4 are previously attached in order to shorten the construction period. The construction methods of plant facilities have been disclosed in Japanese Patent Application Laid-Open (JP-A) No. 62-228975 and JP-A No. 2000-72379.

In the pipe module construction method disclosed in JP-A No. 62-228975, unitization is performed by previously assembling devices, pipes and the like to a structure at an external factory. After a floor of a device room is constructed, the unit is transported and attached, and then, pipes, ventilation ducts and the like are connected. In this manner, easiness and rapidness of the construction is improved.

In the pipe module construction method disclosed in JP-A No. 2000-72379, a structural component is hung from a ceiling board via hanging means and moved on a movement rail while maintaining the hung state of the structural component. Then, the structural component is pulled up by a crane and transported to an attaching position.

Here, in the pipe module construction method disclosed in JP-A No. 62-228975, a variety of devices and pipes are conclusively assembled to designed positions of conclusive operational mounting in a factory, and then, are carried into a job site and fixed by welding and the like for each pipe module. Therefore, at a job site where the conclusive operational mounting is not planned in a cell, the pipe cannot be arranged at a normal position. Accordingly, there have been a number of areas where the module construction method cannot be adopted. In addition, there have been problems of restriction of largeness and weight of the module to be transported from a factory, increase in transportation cost, and the like.

In the pipe module construction method disclosed in JP-A No. 2000-72379, since the structural component is hung by the hanging means, it is unnecessary to arrange a member for preventing falling of the structural component and a member for temporal arranging reinforcement. Accordingly, labor hours for forming and disassembling can be reduced. However, since the hanging means cannot hang structural components which are vertically overlapped, there has been a problem of limited adaptability. In addition, in the case of overlapping of several structural components, there has been a problem of poor positioning accuracy.

To address the abovementioned issues of the related art, the present invention provides a module structure and a plant construction method capable of modularizing outdoors for a cell where conclusive operational mounting is not planned and a pipe module cannot be planned and capable of shortening a plant construction period.

SUMMARY

A module structure of the present invention includes a support member which temporarily supports a facility device component to be arranged in a cell constituting a plant at a designed position and which constitutes scaffolding for attaching the facility device component and forming the cell, a box-shaped frame which is possible to be carried into inner space of the cell while fixing the support member, and joint means which is detachably attachable and which temporarily assembles the support member and the frame.

In this case, the joint means may include a connection fitting having a plurality of fit holes formed and a pin being fitted to the fit hole and the joint means may be fixed by inserting the pin while the fit holes are aligned to openings formed at the support member and the frame.

Further, a pair of support pieces may be formed at both ends of one side arm of the connection fitting and a fit hole may be formed at the support piece at a position corresponding to the opening of the frame.

Further, the support member may be formed by sterically combining a plurality of members mutually having an arbitrary interval and angle in the frame.

Further, the facility device component may be temporarily fixed to the support member with a clamp.

Furthermore, the clamp may include one or plural fixing portions to fix the support member and a support portion to confine a pipe which constitutes the facility device component, and the fixing portion and the support portion may be connected at a connection position corresponding to attaching attitude of the pipe.

A plant construction method of the present invention includes forming a module structure within a movable range of a crane from an arranging location of a facility device component, the module structure including a support member which temporarily supports the facility device component to be arranged in a cell constituting a plant at a designed position and a frame which fixes the support member, carrying the module structure into the cell at the arranging location of the facility device component with the crane after a floor face of the cell is constructed, forming a wall face or a ceiling face of the cell in parallel to attaching of the facility device component into the cell, and removing by disassembling the frame or the support member in the module structure after forming the wall face or the ceiling face.

The module structure of the present invention includes the support member which temporarily supports the facility device component at the designed position and which constitutes the scaffolding for attaching the facility device component and forming the cell and the box-shaped frame which is possible to be carried into the inner space of the cell while fixing the support member, and then, the support member and the frame are temporarily assembled with the detachably attachable joint means. Accordingly, in the case that the conclusive operational mounting is not planned, namely, in the case that a pipe is to be attached in the air of the cell, the construction operation of the wall face and the ceiling face of the cell can be performed in parallel to attaching of the facility device components such as devices and pipes. Accordingly, it is possible to shorten the construction period. Further, since the module structure temporarily supports the facility device component, it is easy to perform position adjustment with substructure such as embedded ironware and previously arranged pipes when being carried into the cell and conclusively arranged.

Further, since the support member of the module structure constitutes the scaffolding for both attaching operation and constructing operation while temporarily supporting the facility device component, it is possible to perform construction operation of the cell in parallel to the attaching and scaffolding is not newly required at the attaching position. Accordingly, the construction period can be shortened.

DETAILED DESCRIPTION OF EMBODIMENTS

In the following, embodiments of the present invention will be described with reference to the drawings.

Figure 1:
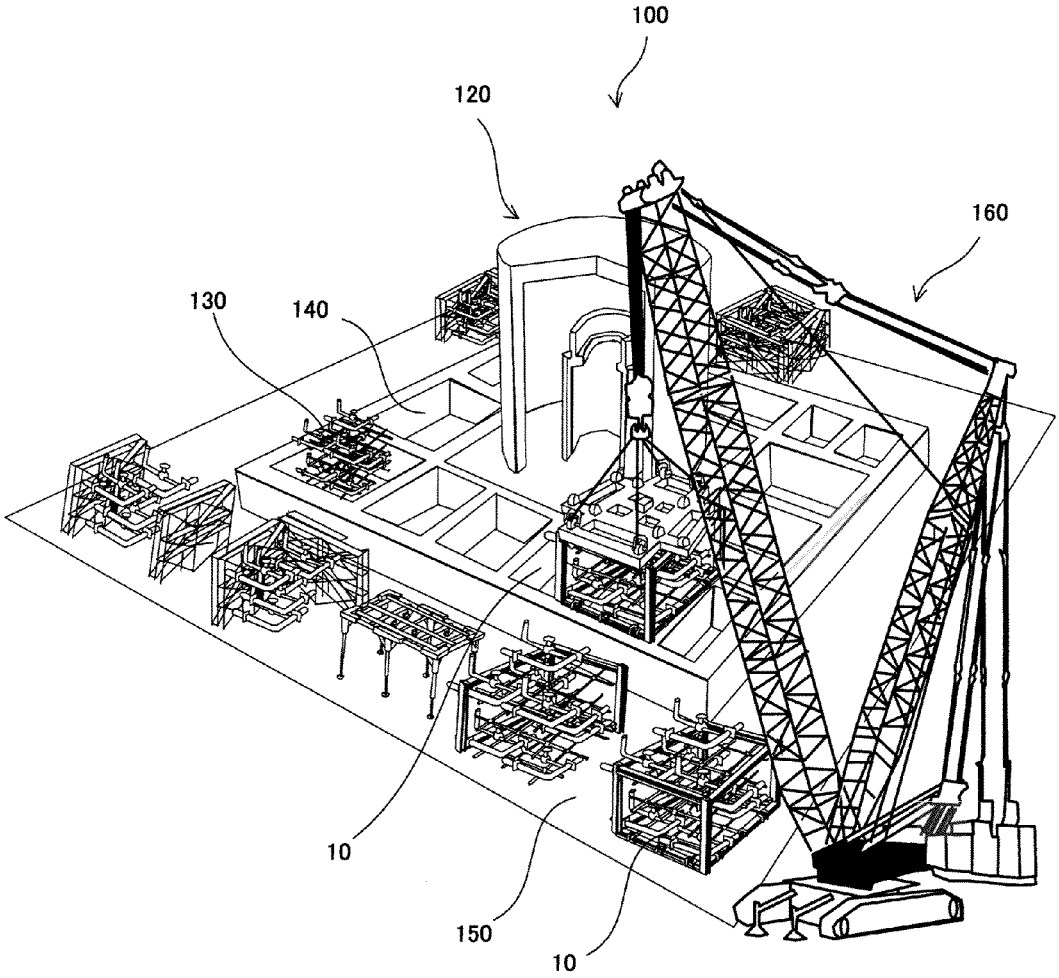
FIG. 1 is an explanatory view of a plant.
Figure 2:
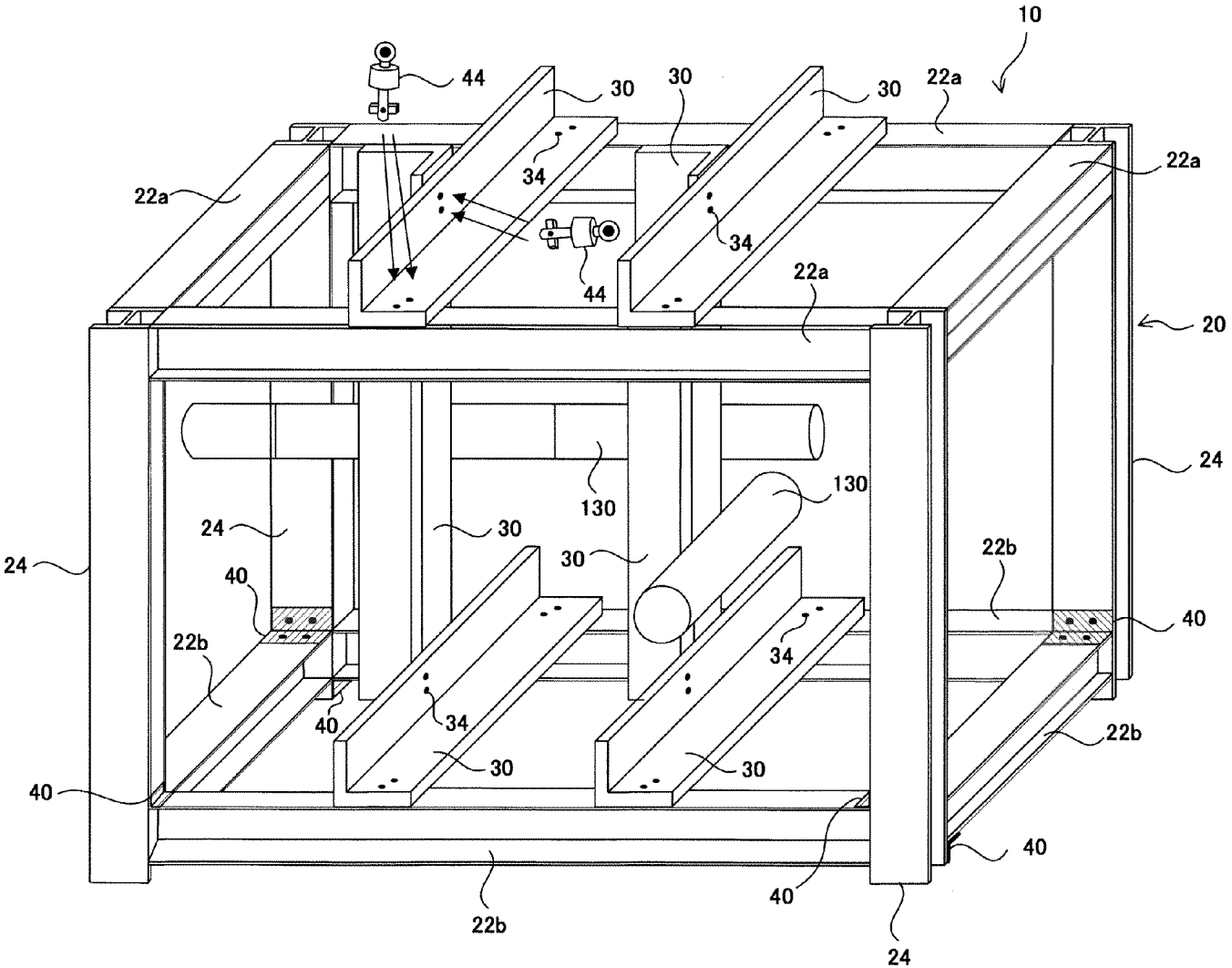
FIG. 2 is an explanatory view of a module structure according to an embodiment of the present invention.

FIG. 1 is an explanatory view of plant facilities. FIG. 2 is an explanatory view of a module structure according to an embodiment of the present invention.

As illustrated in FIG. 1, following description is performed on a nuclear power generation plant as an example of a plant to which the module structure of the present invention is applied. A nuclear power generation plant 100 is constituted with a number of facility devices in addition to a nuclear reactor pressure vessel 120 at a center part. Cells 140 which are plurally divided for each facility device and the like are formed around the nuclear reactor pressure vessel 120. A variety of facility devices and a number of pipes (i.e., facility device components 130) are attached to the cells 140.

A module structure 10 of the present invention is formed to be a box shape capable of being carried into inner space of the cell 140 with a large crane 160. As illustrated in FIG. 2, the module structure 10 is constituted with a frame 20, support members 30, and joint means 40.

The frame 20 has predetermined strength for carrying-in the facility device components 130 such as the facility devices and pipes to be arranged in the cell 140 from the outside, as illustrated in FIG. 1. For example, the frame 20 is formed of a plurality of horizontal frames 22 and vertical frames 24 made of H-shaped iron beams. The frame 20 is formed to be a box shape capable of being carried into the inner space of the cell 140 as illustrated in FIG. 2 by combining the horizontal frames 22 and the vertical frames 24. For assembling the horizontal frames 22 and the vertical frames 24, a horizontal frame 22*a* at the upper face to be a hanging face and the vertical frame 24 are fixed by fixing means such as welding. Then, a horizontal frame 22*b* at the lower face and the vertical frame 24 are temporarily assembled by utilizing detachably attachable joint means 40 which is described later. Here, the temporal assembling is designed to maintain strength capable of supporting weight of the facility device components 130 to be carried into the cells 140.

The support member 30 is to temporarily support the facility device component 130 to be arranged in the cell 140 at a designed position, that is, the position within the module structure 10 corresponding to the designed position where the facility device component 130 is to be arranged in the inner space of the cell 140 when the module structure 10 is carried into the cell 140. For example, as illustrated in FIG. 2, an L-shaped iron beam may be used as the support member 30. The support member 30 is temporarily fixed to the frame 20 while temporarily supporting the facility device component 130 by utilizing the later-mentioned joint means 40 or a clamp 50. Here, the support members 30 are configured to be requisite minimum arrangement corresponding to conclusive piping routs and to have strength to support hanging load with a large crane 160. Accordingly, weight and cost of the support members 30 to be temporal structural members can be significantly reduced.

Figure 3:
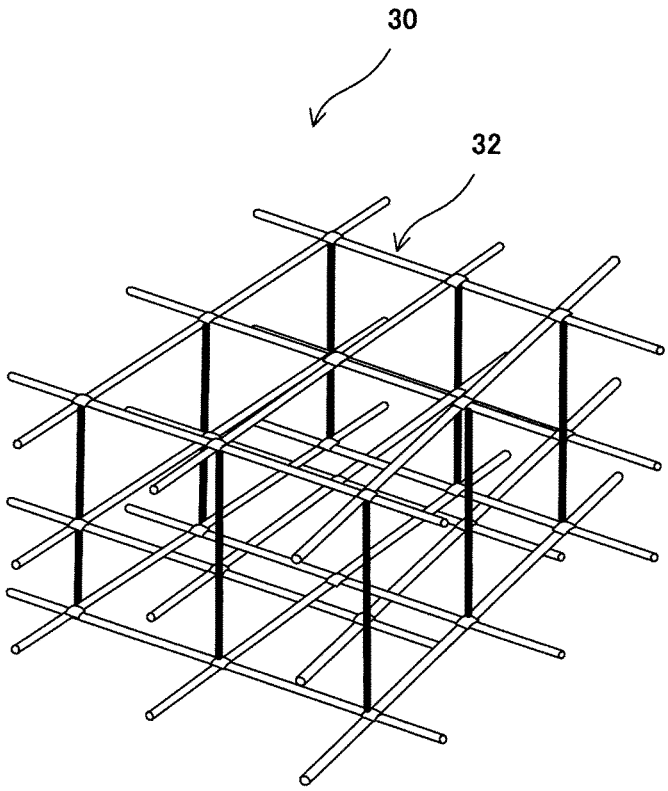
FIG. 3 is an explanatory view of a modified example of a support member.

FIG. 3 is an explanatory view of a modified example of the support member 30. As illustrated in this drawing, the support member 30 is formed by combining a plurality of short pipes 32 to be grid-shaped within the box-shaped frame 20, that is, sterically combining the plurality of short pipes 32 mutually having arbitrary intervals and angles. Accordingly, the support member 30 can be utilized as scaffolding for construction while temporarily supporting the facility device component 130.

Figure 4A:
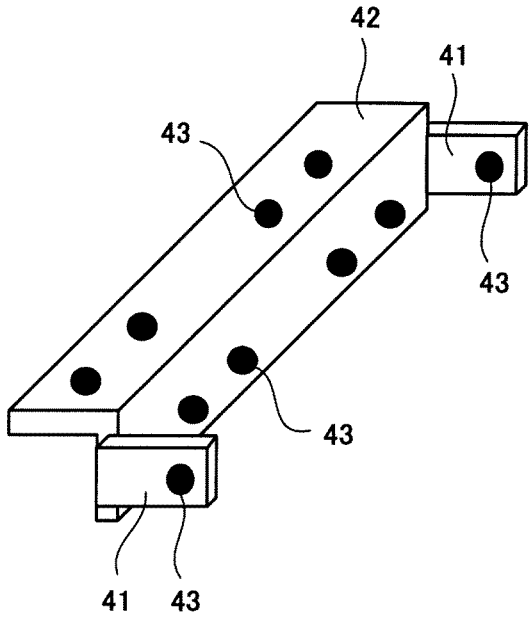
FIG. 4A is a perspective view of a connection fitting of joint means.
Figure 4B:
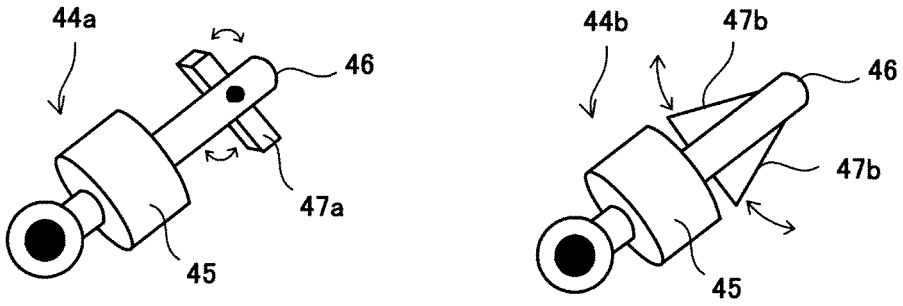
FIG. 4B is a perspective view of a pin of the joint means.
Figure 4C:
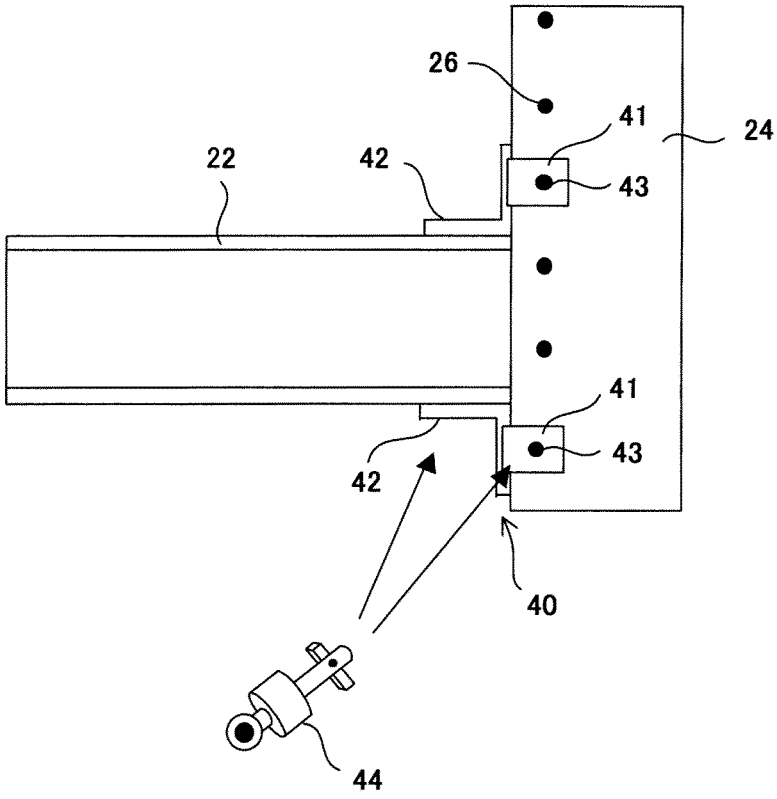
FIG. 4C is an explanatory view of the joint means attached to a frame.

FIGS. 4A, 4B, 4C, and 4D are explanatory views of the joint means 40. FIG. 4A is a perspective view of a connection fitting. FIG. 4B is a perspective view of a pin. FIG. 4C is an explanatory view of the joint means 40 attached to the frame. As illustrated in the drawings, the joint means 40 is constituted with a connection fitting 42 and a pin 44.

For example, in the connection fitting 42, a plurality of fit holes 43 are formed at predetermined intervals at a side face of an L-shaped iron beam having length matched to the frame width of the frame 20. Further, a plurality of openings 34, 26 are formed along the longitudinal direction of the support member 30 and the frame 20 at the same intervals as those of the fit holes 43. Further, a pair of support pieces 41 are formed at both ends of one side arm of the connection fitting 42. A fit hole 43 is formed at the support piece 41 at the position corresponding to the opening 26 of the frame 20. When the horizontal frame 22 and the vertical frame 24 are temporarily assembled as illustrated in FIG. 4C, there is a case that a face of an H-shaped section of the vertical frame 24 is not contacted to a side face of the connection fitting 42. Accordingly, by arranging the support piece 41 in the direction intersecting to one side arm of the connection fitting 42, the fit hole 43 and the opening 26 can be aligned while contacting the support piece 41 of the connection fitting 42 to the face of the vertical frame 24.

The pin 44 is constituted with a knob portion 45 and an insertion portion 46. The insertion portion 46 is a member to be inserted into the fit hole 43 and the openings 26, 34. The insertion portion 46 is designed to have a slightly smaller diameter than the hole diameters of the fit hole 43 and the openings 26, 43. A hook 47 is formed at a side face of the insertion portion 46. A hook 47*a* of a pin 44*a* illustrated in FIG. 4B has a rotation axis formed in the intersecting direction to the axis at the top side of the insertion portion 46. With this configuration, the pin 44 can be fixed in a fitted state by rotating the hook 47*a* at the top to the intersecting position to the axis after inserting the insertion portion 46 into the fit hole 43 and the opening 26. Here, the pin 44*a* can be easily detached from the fit hole 43 and the opening 26 by rotating the hook 47*a* to the position being parallel to the axis.

Meanwhile, a pair of hooks 47*b* are formed at a pin 44*b* along the longitudinal direction of the insertion portion 46. An elastic member (not illustrated) is arranged within the insertion portion 46, and then, the hook 47*b* is projected from a side face of the insertion portion 46 having a triangular projection capable of projecting and entering.

With this configuration, when the insertion portion 46 is inserted into the fit hole 43 and the opening 26, the hook 47*b* is pressed by the hole side face and accommodated in the insertion portion 46. Then, after penetrating, the hook 47*b* is pressed out by the elastic member in the insertion portion 46, so that the pin 44 can be fixed in a fitted state. Here, the pin 44*b* is easily detached from the fit hole 43 and the opening 26 in a state that the hook 47*b* is pressed to be accommodated in the insertion portion 46.

Meanwhile, the support member 30 can be fixed by inserting the pin 44 into the opening without using the joint fitting 42.

Figure 5A:
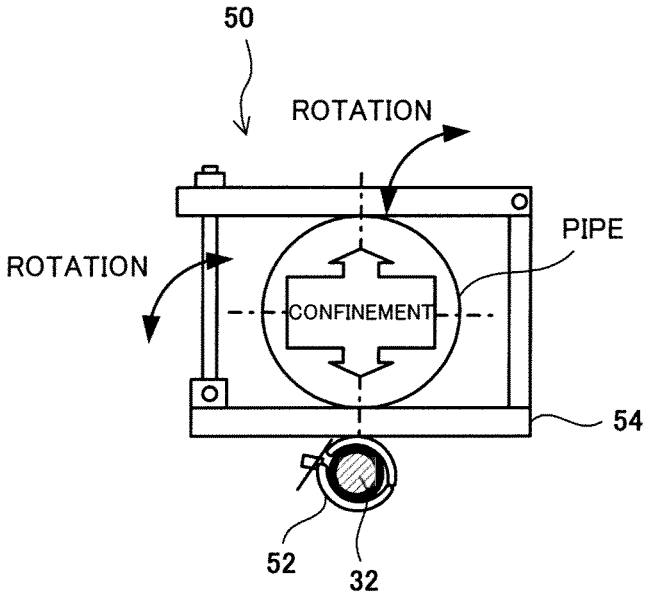
FIG. 5A is an explanatory view of a clamp.
Figure 5B:
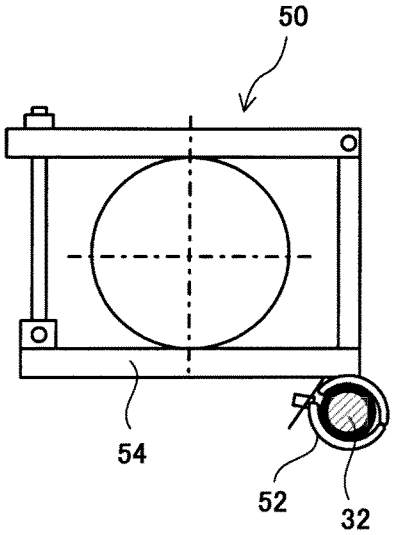
FIG. 5B is an explanatory view of a modified example of the clamp.
Figure 5C:
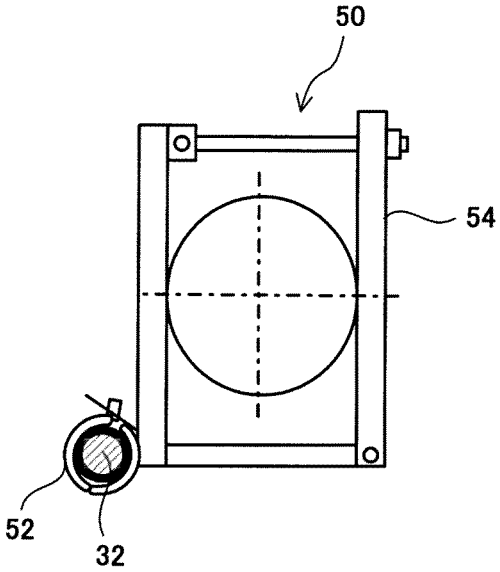
FIG. 5C is an explanatory view of another modified example of the clamp.
Figure 5D:
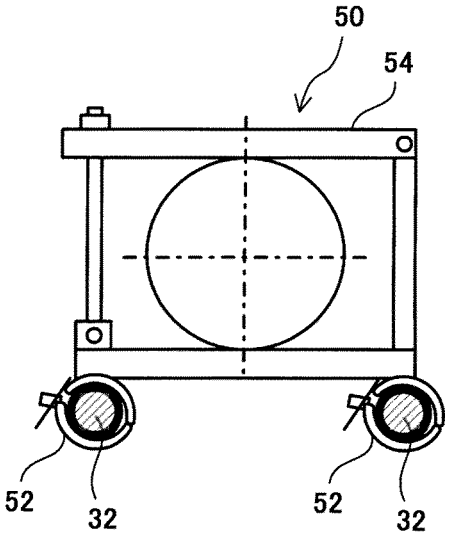
FIG. 5D is an explanatory view of another modified example of the clamp.

FIGS. 5A, 5B, 5C and 5D are explanatory views of the clamp 50 to illustrate a clamp method in the case that the configuration of FIG. 3 is adopted. The clamp 50 is a jig to fix the facility device component 130 to the support member 30. Here, an example of utilizing short pipes 32 for the support member 30 is illustrated in FIGS. 5A, 5B, 5C and 5D. As illustrated in the drawings, the clamp 50 is constituted with a fixing portion 52 to be connected to the short pipe 32 and a support portion 54 to confine the piping of the facility device component 130. The fixing portion 52 is a clip to hold and fix the outer circumference of the short pipe 32. The support portion 54 is connected to the fixing portion 52 and connects four pipes into a rectangular shape. In the support portion 54, rotatable pin connection is utilized at the connection portions on a diagonal line of the rectangle formed by the four pipes. With this configuration, the outer circumference of the pipe is fixed by being sandwiched by the support portion 54 and the short pipe 32 is fixed to the fixing portion 52. Besides the clamp 50 illustrated in FIG. 5A, the connection position between the fixing portion 52 and the support portion 54 can be changed in accordance with the attaching position of the facility device component 130 as illustrated in FIGS. 5B and 5C. Further, as illustrated in FIG. 5D, it is also possible to connect two fixing portions 52 with the support portion 54 so that temporal support of the facility device component 130 is reinforced.

Figure 6:
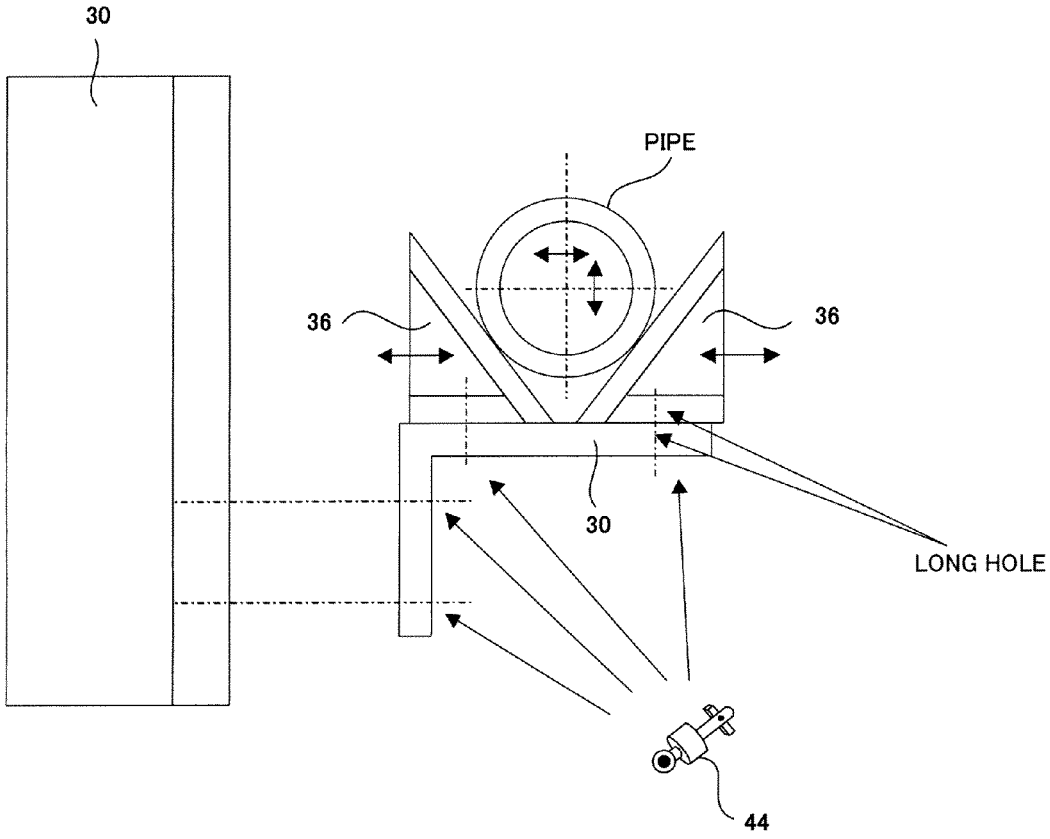
FIG. 6 is an explanatory view of aligning the height and plane position for clamping.

FIG. 6 is an explanatory view of aligning the height and plane position at the time of clamping. In the case that L-shaped beams are used for the support members 30 as illustrated in the drawing, the horizontal face is formed by combining two pieces of the support members 30 in the vertical and horizontal directions with the joint means 40. A pair of adjustment members 36 are attached on the horizontal face by utilizing the pin 44 of the joint means 40. The pipe is mounted on a concave portion which is formed by arranging the adjustment members 36 shaped triangular in section in a state that inclined faces thereof are mutually opposed. The height position of the pipe can be adjusted to the designed position (i.e., the height position or the face position) by appropriately adjusting the attaching position of the pair of adjustment members 36 in the direction intersecting to the pipe axis.

In the following, a plant construction method utilizing the module of the present invention having the abovementioned configuration will be described.

Figure 7:
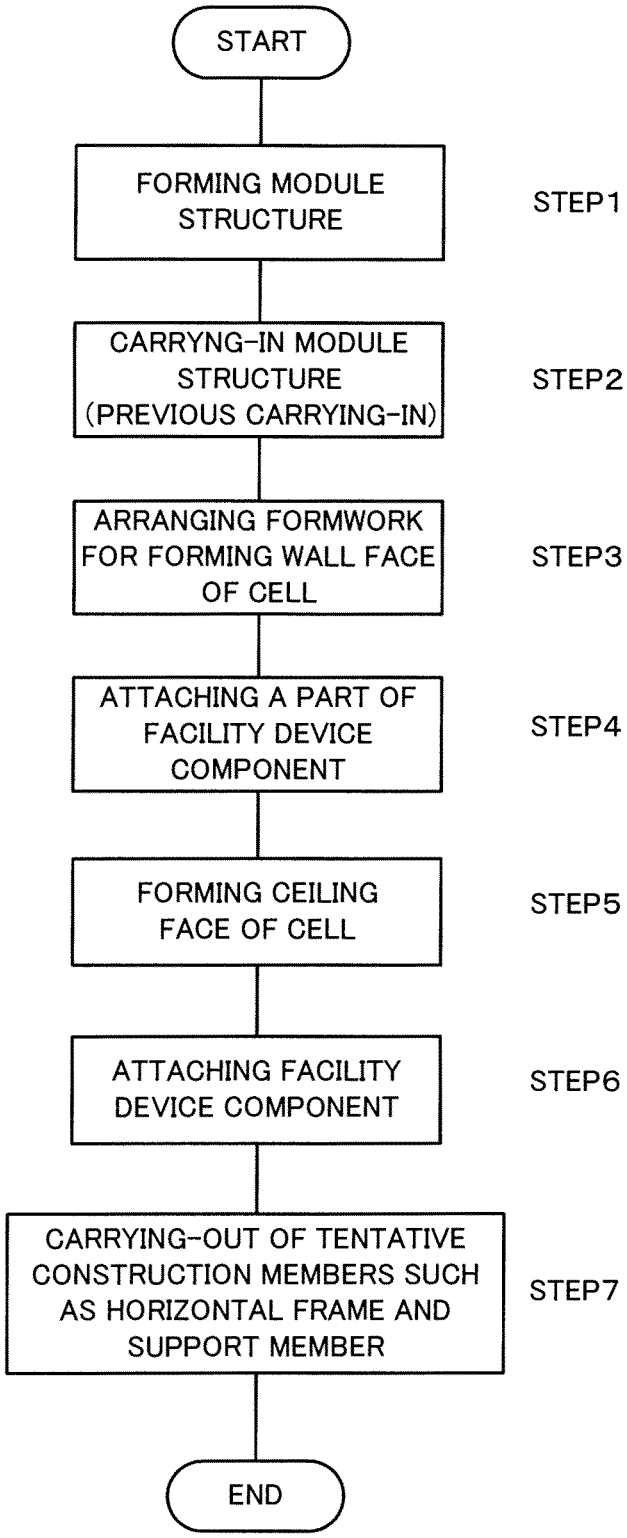
FIG. 7 is a flowchart of a plant construction method according to an embodiment of the present invention.
Figure 8A:
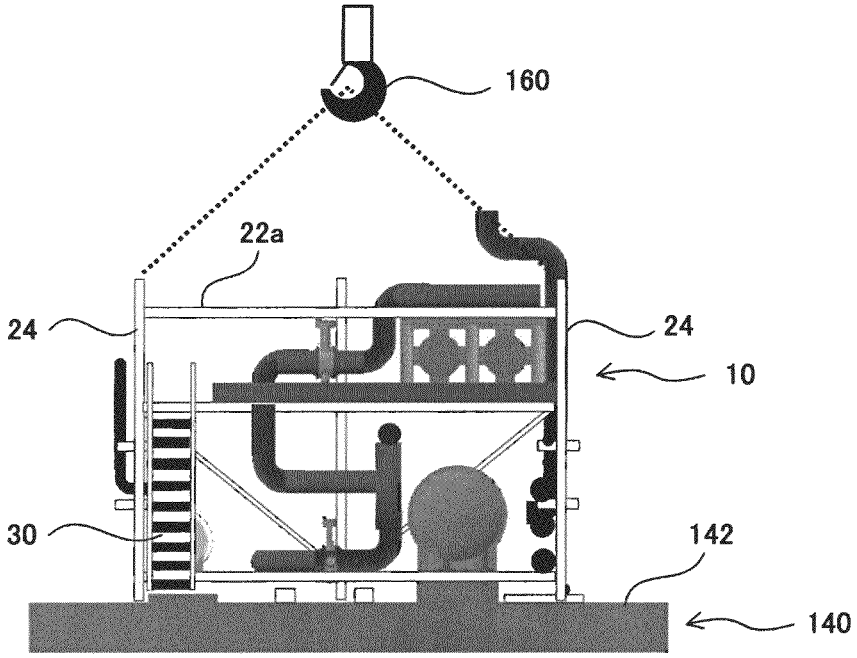
FIG. 8A is an explanatory view of processes from carrying-in the module structure to forming a wall face.
Figure 8B:
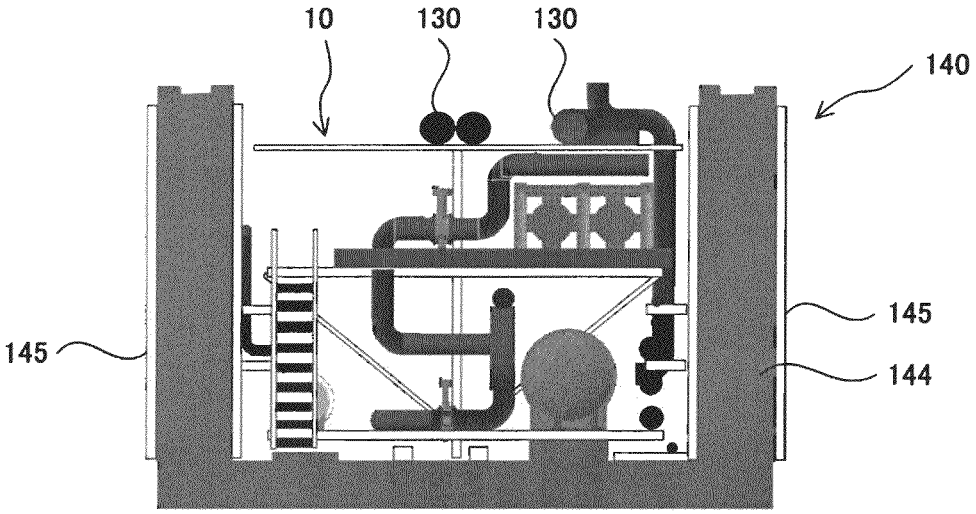
FIG. 8B is an explanatory view of processes from carrying-in the module structure to forming the wall face.
Figure 8C:
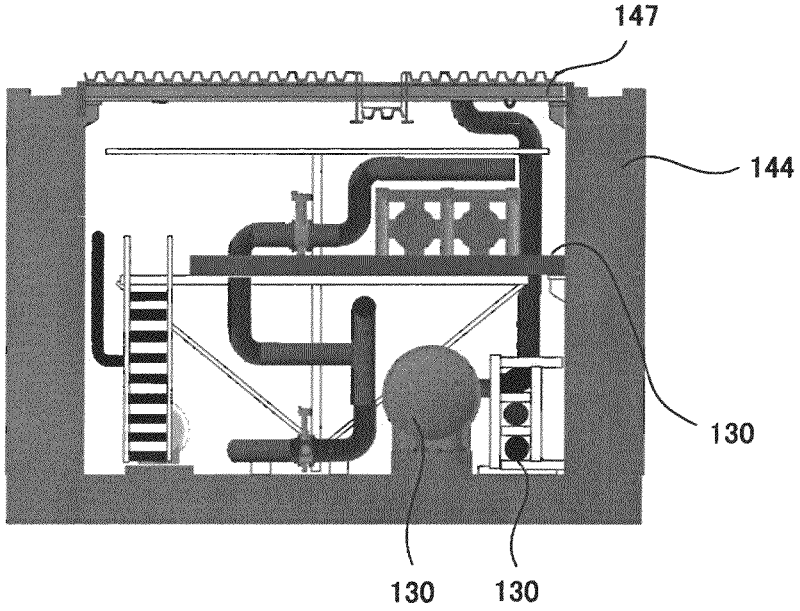
FIG. 8C is an explanatory view of processes from carrying-in the module structure to forming the wall face.
Figure 9A:
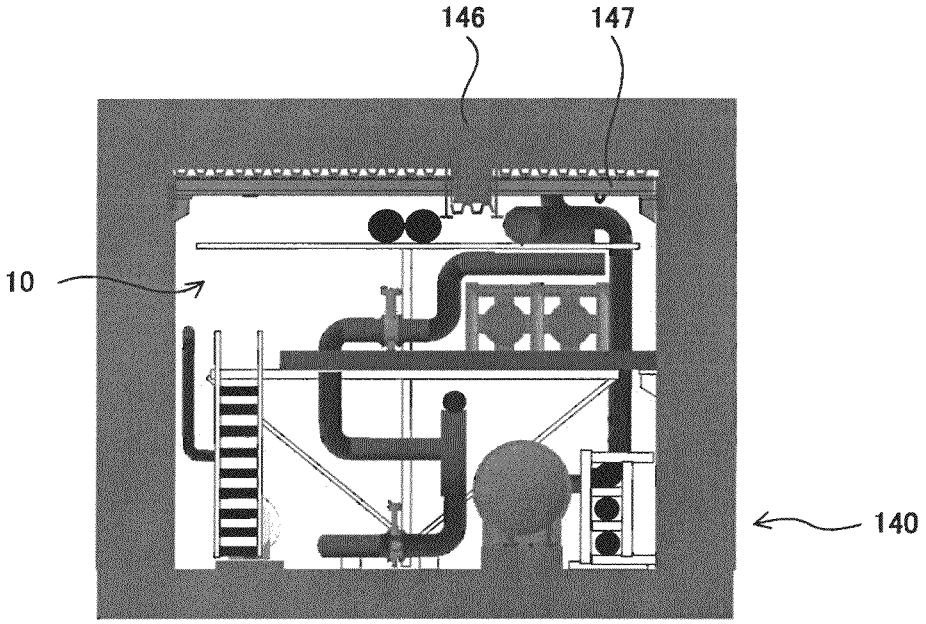
FIG. 9A is an explanatory view of processes from forming a ceiling face to carrying-out the frame and the support member of the module structure.
Figure 9B:
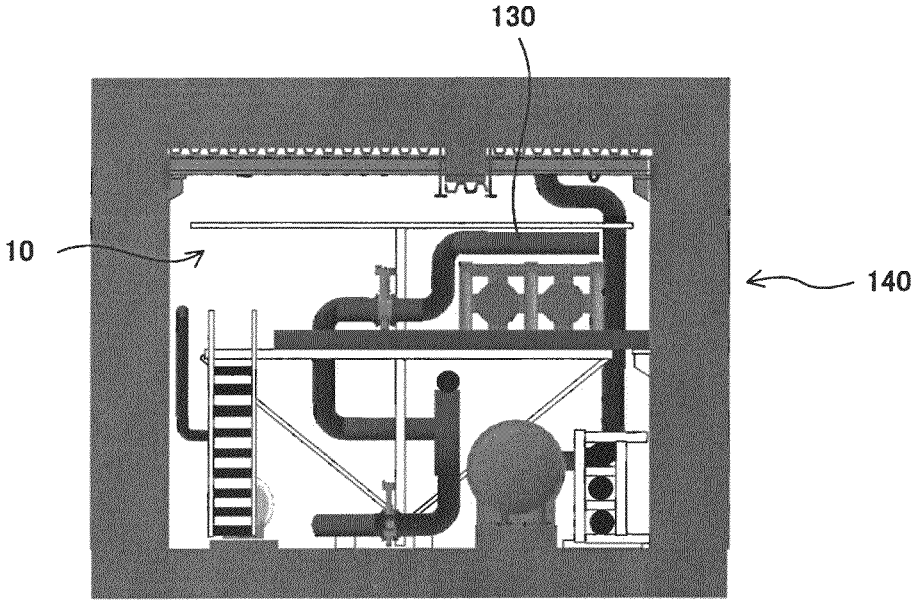
FIG. 9B is an explanatory view of processes from forming the ceiling face to carrying-out the frame and the support member of the module structure.
Figure 9C:
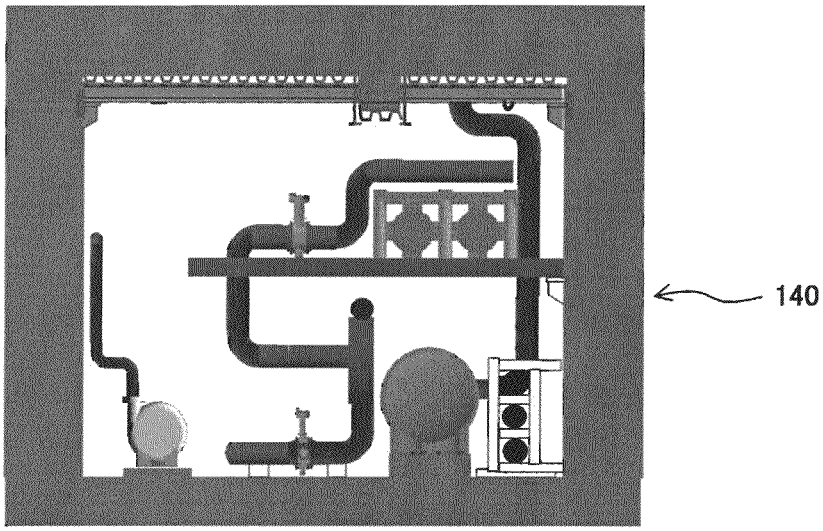
FIG. 9C is an explanatory view of processes from forming the ceiling face to carrying-out the frame and the support member of the module structure.
Figure 10A:
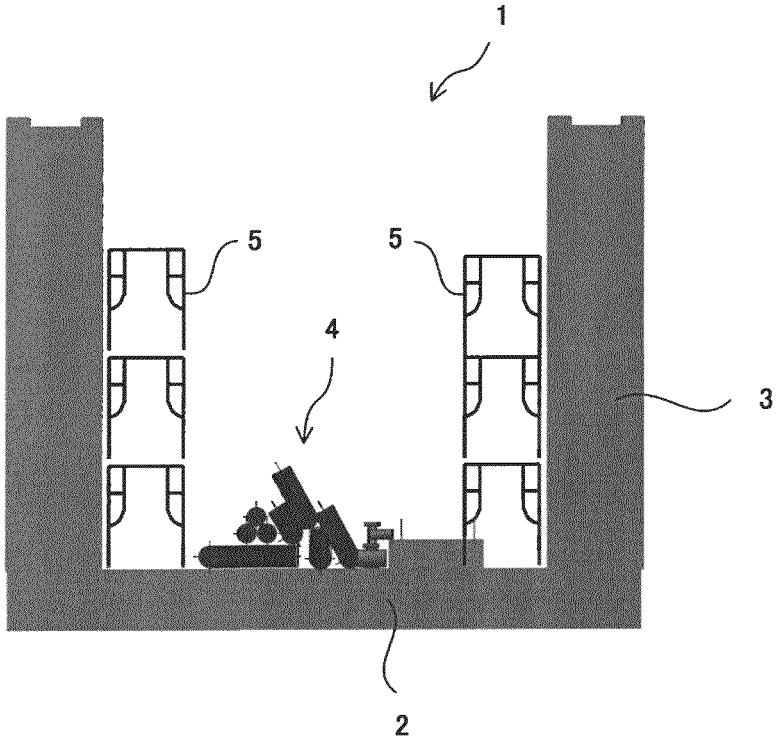
FIG.10A RELATED ART
FIG. 10A is an explanatory view of a plant construction method in the related art.
Figure 10B:
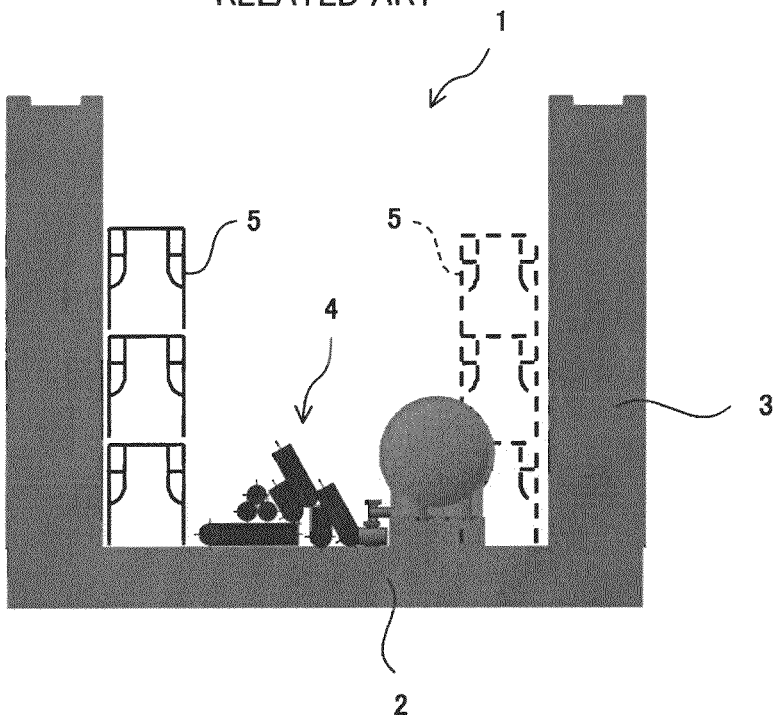
FIG.10B RELATED ART
FIG. 10B is an explanatory view of the plant construction method in the related art.

FIG. 7 is a flowchart of the plant construction method. FIGS. 8A, 8B and 8C are explanatory views of processes from carrying-in the module structure 10 until forming wall faces of the cell 140. FIGS. 9A, 9B and 9C are explanatory views of processes from forming a ceiling face of the cell 140 until carrying-out the frame 20 and the support member 30 of the module structure 10.

An assembling area 150 where the module structure 10 is temporarily placed when the module structure 10 is carried into the cell 140 by being hung-up with the large crane 160 is prepared around the plant building as illustrated in FIG. 1. The module structure 10 according to the embodiment of the present invention is formed within the assembling area 150. Accordingly, compared to a case of transporting the module structure 10 from a factory, means to fix devices can be simplified and position adjustment and position change thereafter can be easily performed. In addition, compared to the case of transporting to the building vicinity by transportation means after being previously assembled at a factory and the like outside the plant building, transportation cost can be reduced. In a forming process of the module structure 10, the box-shaped frame 20 matched to the inner space of the cell 140 for carrying-in is formed. Specifically, the horizontal frame 22*a* at the upper face to be the hanging face and the vertical frames 24 are fixed by the fixing means such as welding. Then, the horizontal frame 22*b* at the lower face and the vertical frame 24 are temporarily assembled by utilizing the detachably attachable joint means 40. Next, by utilizing the frame 20 or the support member 30, the facility device component 130 is temporarily supported at the designed position, namely, so that the facility device component 130 can be maintained at normal attaching attitude in the inner space of the cell 140 when the module structure 10 is carried into the cell 140. At that time, the pipe of the facility device component 130 is attached to the support member 30 by utilizing the clamp 50. In accordance with the attaching attitude of the pipe, the clamp 50 having the connection position between the fixing portion 52 and the support portion 54 is adjusted is utilized (Step 1).

Next, as illustrated in FIG. 8A, the module structure 10 is carried (i.e., previously carried) into the cell 140 of the plant having concreting on a floor face 142 thereof completed with the large crane 160 (Step 2). At that time, the cell 140 has at least the floor face 142 formed. Here, the cell 140 indicates a case where operational mounting of a conclusive arrangement is not planned. That is, the operational mounting of the conclusive arrangement forms a side face of the cell 140 by casting concrete to the frame 20, so that the facility device component 130 directly becomes the mounting which is to be fixed (i.e., conclusively arranged) at the designed position. Here, in the module structure 10 according to the embodiment of the present invention, the frame 20 does not constitute the wall face and is temporal mounting which does not constitute the mounting of conclusive arrangement. Further, in addition to temporarily supporting the facility device component 130, the support member 30 can be utilized as scaffolding for attaching operation and scaffolding for construction when forming the wall face or the ceiling face of the cell.

After the module structure 10 is carried into the cell 140, the joint means 40 for the support members 30 temporarily fixed to the horizontal frame 22*a* of the hanging face (i.e., the upper face) and the vertical frame 24 is detached. Then, only the horizontal frame 22*a* and the vertical frame 24 are hung-up with the large crane 160 and removed from the cell 140. Accordingly, the minimum frame 20 and support member 30 necessary to temporarily support the facility device component 130 remain in the cell 140, and then, operational space can be ensured while efficiently removing the frame 20 which became unnecessary.

In addition, times of carrying-in of the facility device components 130 with the large crane 160 can be reduced. Further, the support member 30 constituting the operational scaffolding of the module structure 10 can also function as forming the wall face or attaching the facility device component 130 right after being carried-in.

As illustrated in FIG. 8B, formwork 145 for concreting is arranged at the outer circumference of the module structure 10 when forming the wall face 144 of the cell 140 (Step 3). Further, it is also possible to add the facility device component 130 from the ceiling face at the upper face space of the module structure 10. Then, the concrete wall face 144 is formed by pouring concrete into the formwork 145.

As illustrated in FIG. 8C, a part of the scaffolding for construction of the formwork 145 and the wall face 144 is removed after concreting. Next, formwork 147 to form the ceiling face is attached at the upper face of the module structure 10. In parallel to this process, connecting operation between the wall face 144 and the facility device component 130 is performed and attaching operation of the facility device component 130 is performed at a lower layer area of the cell 140 (Step 4). Then, a part of the support members 30 which became unnecessary after the attaching operation is removed.

Next, as illustrated in FIG. 9A, the ceiling face 146 is formed by casting concrete to the formwork 147 of the ceiling face. After concreting, painting of the inside of the cell 140 is performed and operational scaffolding used for the building construction is removed (Step 5).

As illustrated in FIG. 9B, attaching operation of the rest of the all facility device components 130 in the cell 140 is preformed and painting and temperature keeping of the facility device components 130 after being attached are performed (Step 6).

Finally, as illustrated in FIG. 9C, the horizontal frames 22*a* and the support members 30 constituting the module structure 10 is disassembled in the module structure and carried-out from the building, so that the attaching of the facility device components 130 in the cell 140 is completed (Step 7).

In the above description of the embodiment, the module structure and the plant construction method of the present invention are applied to a nuclear power generation plant. However, not limited to this, the present invention is also applicable for a variety of industrial plants.

With the module structure 10 and the plant construction method according to the embodiment of the present invention, it is possible to carry the module structure 10 in which the facility device components 130 to be arranged in the cell 140 is temporarily supported at the designed position into the cell 140 and to form the wall face and ceiling face of the cell 140 in parallel to the attaching of the facility device components 130 in the cell 140. In this manner, the plant construction period can be significantly shortened.

The invention claimed is:

1. A modular structure comprising: a support member which temporarily supports a facility device component to be attached in an inner space of a cell constituting a plant and which constitutes scaffolding for attaching the facility device component and for forming the cell;

a box-shaped frame which temporarily supports the facility device component in a standing position as the facility device component is carried into the inner space of the cell, wherein the standing position corresponds to an attaching attitude of the facility device component being attached in the inner space of the cell, and the support member is anchored to the facility device component in the standing position at a position outside of the cell; and wherein the box-shaped frame consists of a first part which is a combination of a horizontal frame and a vertical frame and a second part which is a horizontal frame;

wherein the support member consists of a first support member which is temporarily supported by the second part, the first support member bridges the second part of the box-shaped frame and a second support member which is temporarily supported by the first support member and temporarily supports the facility device component;

wherein the second support member extends vertically and its bottom is supported by the first support member of the support member;

a joint means which is detachably attachable and which temporarily assembles the first part to the second part of the box-shaped frame, and a top of the second support member of the support member to the first part of the box-shaped frame; wherein the box-shaped frame occupies the inner space of the cell such that the dimensions of an outer shape of the box-shaped frame are substantially equal to the dimensions of the inner space of the cell, and wherein when the module structure is hung up and carried into the cell, the second support member will be supported by the first support member of the support member and the second part of the box-shaped frame, the joint means are detachable to remove the first part;

wherein the first and second support members of the support member and the second part of the boxed-shaped frame are removable after the facility device component is attached to the cell.

2. The modular structure according to claim 1, wherein the joint means includes a connection fitting having a plurality of fit holes and pins being fitted to the plurality of fit holes; and the joint means is anchored by inserting at least one of the pins into at least one of the plurality of fit holes while the plurality of fit holes are aligned to openings formed in the support member and the frame.

3. The modular structure according to claim 2, wherein a support piece is formed at both ends of one side arm of the connection fitting; and one of the plurality of fit holes is formed in the support piece at a position corresponding to the one of the openings of the frame.

4. The modular structure according to claim 1, wherein the support member is formed by sterically combining a plurality of members mutually having an arbitrary interval and angle in the frame.

5. The modular structure according to claim 1, wherein the facility device component is temporarily anchored to the support member with a clamp.

6. The modular structure according to claim 5, wherein the clamp includes one or more anchoring portions to be anchored to the support member and a support portion to confine a pipe which constitutes the facility device component; and the one or more anchoring portions and the support portion are connected at a connection position corresponding to an attaching attitude of the pipe.

7. A modular structure comprising: a box-shaped frame configured to match to an inner space of a cell constituting a plant, wherein the box-shaped frame comprises detachably attachable joint means for temporarily assembling the box-shaped frame;

at least one support member detachably attached to the box-shaped frame;

wherein the box-shaped frame and the at least one support member are configured to temporarily support a facility device component in a standing position, wherein the standing position corresponds to an attaching attitude of the facility device component in the inner space of the cell, wherein the box-shaped frame consists of a first part which is a combination of a horizontal frame and a vertical frame and a second part which is a horizontal frame;

wherein the support member consists of a first support member which is temporarily supported by the second part, the first support member bridges the second part of the box-shaped frame and a second support member which is temporarily supported by the first support member and temporarily supports the facility device component;

wherein the second support member extends vertically and its bottom is supported by the first support member of the support member;

wherein the joint means temporarily assembles the first part to the second part of the box-shaped frame, and a top of the second support member of the support member to the first part of the box-shaped frame;

wherein the box-shaped frame occupies the inner space of the cell such that the dimensions of an outer shape of the box-shaped frame are substantially equal to the dimensions of the inner space of the cell, and wherein when the module structure is hung up and carried into the cell, the second support member will be supported by the first support member of the support member and the second part of the box-shaped frame, the joint means are detachable to remove the first part;

wherein the first and second support members of the support member and the second part of the boxed-shaped frame are removable after the facility device component is attached to the cell.

8. The modular structure according to claim 7, wherein the facility device component is configured to be temporarily anchored to the support member with a clamp.

9. The modular structure according to claim 8, wherein the clamp includes one or more anchoring portions to anchor the support member and a support portion to confine a pipe which constitutes the facility device component while supported at the anchoring portion; and the one or more anchoring portions and the support portion are connected at a connection position corresponding to an attaching attitude of the pipe.

* * * * *